US007182155B2

(12) United States Patent
Lange

(10) Patent No.: US 7,182,155 B2
(45) Date of Patent: Feb. 27, 2007

(54) LOCKING SPLIT BARREL SAMPLER AND SOIL SAMPLING SYSTEM

(75) Inventor: James E Lange, LaPorte, IN (US)

(73) Assignee: Diedrich Drill, Inc., LaPorte, IN (US)

( * ) Notice: Subject to any disclaimer, the term of this patent is extended or adjusted under 35 U.S.C. 154(b) by 226 days.

(21) Appl. No.: 10/683,971

(22) Filed: Oct. 10, 2003

(65) Prior Publication Data

US 2004/0079550 A1 Apr. 29, 2004

Related U.S. Application Data

(60) Provisional application No. 60/418,849, filed on Oct. 16, 2002.

(51) Int. Cl.
*E21B 25/00* (2006.01)

(52) U.S. Cl. ..... 175/244; 175/320; 285/373; 285/419

(58) Field of Classification Search ..... 403/339, 403/340; 285/373, 419; 166/380, 242; 175/244, 175/320

See application file for complete search history.

(56) References Cited

U.S. PATENT DOCUMENTS

| | | | | |
|---|---|---|---|---|
| 5,086,854 A | | 2/1992 | Roussy | |
| 5,360,072 A | | 11/1994 | Lange | |
| 5,417,290 A | | 5/1995 | Barrow | |
| 5,442,096 A | * | 8/1995 | Urano et al. | 560/190 |
| 5,462,312 A | * | 10/1995 | Carpenter et al. | 285/15 |
| 5,562,169 A | * | 10/1996 | Barrow | 175/56 |

* cited by examiner

*Primary Examiner*—William Neuder
*Assistant Examiner*—Nicole A Coy
(74) *Attorney, Agent, or Firm*—Baker & Daniels LLP

(57) ABSTRACT

Once the core barrel has been inserted into the ground to the appropriate depth for the required soil sample, it may be withdrawn by removing the entire drill string. Once withdrawn, the soil sample may be obtained by unscrewing the adapter coupling 12 and drive shoe 14 from the respective ends of the core barrel. One or both of the halves 110*a*, 110*b* may then be axially slid with respect to one another until locking tabs 142, 152 of locking configurations 160 are offset and become released/disengaged from one another. This allows the halves to be separated so that the soil sample may be readily accessed.

32 Claims, 7 Drawing Sheets

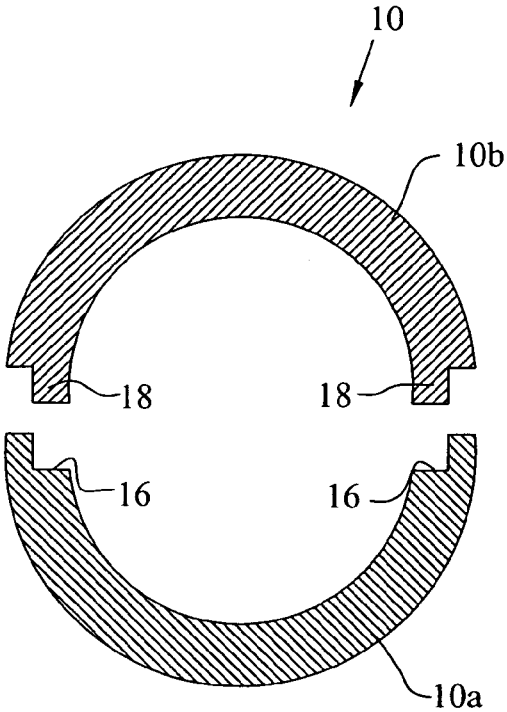
FIG. 3A
PRIOR ART
FIG. 3B
PRIOR ART
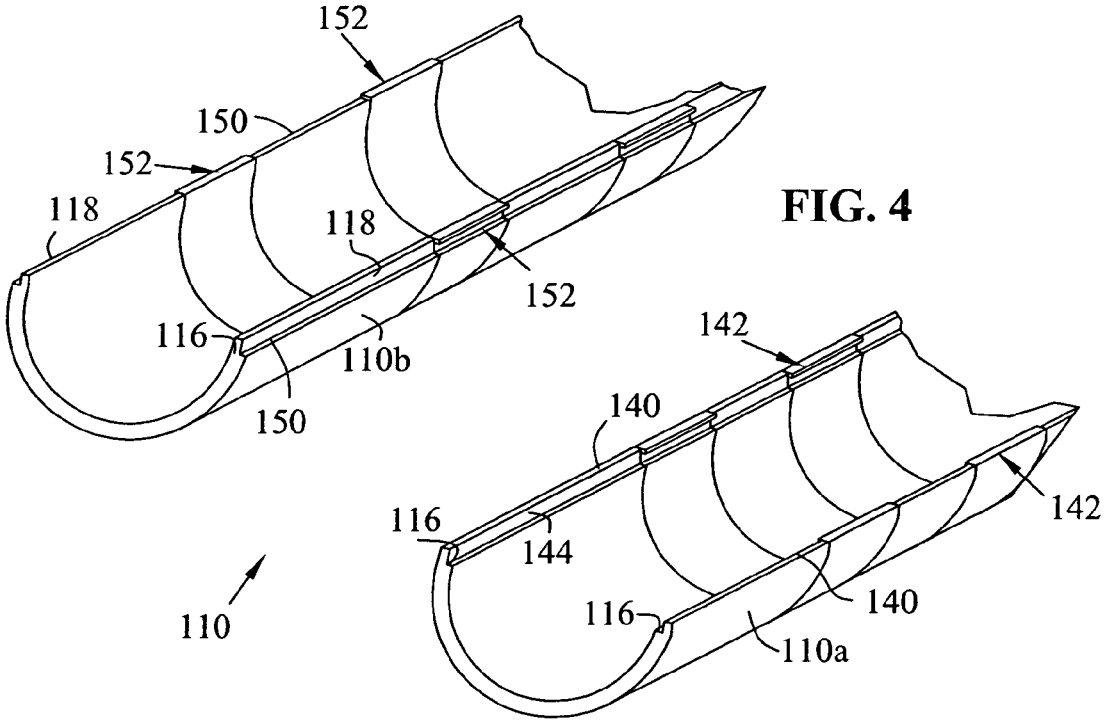
FIG. 4

LOCKING SPLIT BARREL SAMPLER AND SOIL SAMPLING SYSTEM

This application claims the benefit of U.S. Provisional Patent Application Ser. No. 60/418,849 filed Oct. 16, 2002, the complete disclosure of which is hereby expressly incorporated by reference.

BACKGROUND OF THE INVENTION

The present invention relates to a device for use in retrieving geotechnical and environmental soil samples, and in particular, to a split barrel core sampler having a locking configuration to prevent movement of corresponding barrel halves in a direction perpendicular to a plane that divides the barrel into two halves.

Earth probing for environmental and geotechnical soil sampling has become increasingly necessary. Sampling may be done by drilling into the earth and taking samples at predetermined depths, or by driving samplers into the earth. Where possible, driving samplers is usually less expensive and more convenient than drilling. Samplers may be advanced into the earth by pounding, vibrating, and/or pushing the upper end of a drill string to which the sampler is attached.

Samplers used to obtain geotechnical and environmental soil samplers typically use a split barrel design. A complete split barrel sampler assembly consists of a drive shoe for driving into the soil, a two piece split barrel, and an adapter coupling. The split barrel is a tubular member, typically having a round cross-section, split lengthwise to facilitate removal of soil samples contained therein after it is driven in the earth. Typically both ends of the split barrel are externally threaded, and the drive shoe contains a tapered tip on one end for cutting through soil, and an internal thread on the opposite end for mating with the split barrel. Typically the split barrel is attached to a drill rod with an adapter coupling that has internal threads on one end for mating with the drill rod and internal threads on the opposite end for mating with the split barrel.

The sampler is typically driven into the earth a distance approximately equal to the length of the split barrel. The sampler is then pulled from the earth by removing the entire drill string. The drive coupling and drive shoe are removed from the split barrel and the barrel halves are opened up to expose the sample soil. It is very time-consuming to add drill rod for lowering the sampler to the sampling depth, and likewise, to remove drill rod for raising the sampler from the sampling depth. Therefore, it is desirable to use as long of a split barrel as possible to minimize rod handling.

When the drive shoe and the adapter coupling are threaded onto the ends of the split barrel, they constrain the barrel halves from moving with respect to each other in all directions. However, at the middle of the split barrel, there is little influence from the end constraints, especially for longer end barrels. Typical existing split barrel designs utilize a tongue and groove feature that interlocks to prevent lateral movement of one barrel half relative to one another with respect to an axis. However, the tongue and groove feature does not prevent movement of the corresponding barrel halves in a direction perpendicular to a splitting plane (i.e., the plane that divides the barrel into two halves). Consequently, as soil is driven into the sample barrel, the two halves may swell or bow apart from each other. As the adapter coupling and drive shoe constrain the ends of the split barrel, the swelling or separation is greatest at a midpoint between the ends. This may result in the yield strength of the barrel halves being exceeded such that permanent deformation occurs. Deformation of the barrel halves makes it difficult to remove the drive shoe and the adapter coupling.

Therefore, it is an object of the invention to provide a soil sampling system using an improved split barrel design that will constrain the split halves from moving with respect to each other in a direction both lateral to and perpendicular to the splitting plane. It is another object of the invention to provide a split barrel design that will resist permanent deformation of the sampler and have increased useful life by reducing the swelling or bowing apart of the barrel halves from one another as the sampler is driven into the ground. It is a further object of the invention to provide an embodiment of a split barrel sampler that utilizes a tongue and groove feature along the length of the barrel halves to prevent motion parallel to the splitting plane and locking tabs to prevent motion perpendicular to the splitting plane.

SUMMARY OF THE INVENTION

The objects of the invention have been accomplished by providing in one embodiment a core barrel for retrieving soil samples that has two halves configured to be joined substantially along a plane to form a cylinder having a through bore and defining an inner and outer diameter. Each of the halves includes a pair of longitudinally extending edges and a locking configuration to prevent lateral movement of the halves relative to one another with respect to an axis of the core barrel and to also preclude movement of the halves relative to one another in a direction perpendicular to the plane.

It is a feature in one embodiment of the invention that the locking configuration includes locking tongues extending along the length of each edge along the inner diameter on one half. The tongues on the one half each mate with respective notches extending along the length of each edge of the other half.

Another feature of the invention is that one embodiment may include intermittent locking tabs to preclude movement of the halves relative to one another in the direction perpendicular to the joining plane.

An additional feature is that an embodiment may include locking tongues extending along the length of each edge of the inner diameter on one half that mate with respective notches extending along the length of each edge of the other half and wherein the intermittent locking tabs extend from the tongues and notches.

The intermittent locking tabs may also include lips extending the tongues and notches of the respective halves. In one embodiment, the lips extend in a direction substantially parallel to the joining plane.

It is also a feature of the invention that the lips on the one half may extend outwardly from the locking tongues away from the axis of said core barrel, and the lips on the other half may extend inwardly from the notches toward the axis of the core barrel.

In another embodiment of the invention, the core barrel may include full length locking tabs extending from the tongues and grooves of the respective halves to preclude movement of the halves relative to one another in the direction perpendicular to the joining plane.

The objects of the invention have also been realized by providing an embodiment of a soil sampling system that includes a drill rod, a core barrel for receiving a soil sample, an adapter coupling for coupling the core barrel to the drill rod, and a drive shoe attached to an end of the core barrel for penetrating the ground. The core barrel may include two halves configured to be joined substantially along a plane to form a cylinder having a through bore with an inner and outer diameter. Each of the halves includes a pair of longitudinally extending edges, and the halves have a locking configuration to prevent lateral movement of the halves relative to one another with respect to an axis of the core barrel and to also preclude movement of the halves relative to one another in a direction perpendicular to the plane.

The sampling system may include a locking tongue extending along the length of each edge of the inner diameter on one half, and the tongues on the one half may mate with a respective notch extending along the length of each edge of the other half.

Another feature in an embodiment of the sampling system is to include intermittent locking tabs to preclude movement of the halves relative to one another in the direction perpendicular to the joining plane. The intermittent locking tabs may extend from the tongues and notches of the respective halves. The intermittent locking tabs may include lips extending from the tongues and notches of the respective halves. The lips may extend in a direction substantially parallel to the joining plane.

In one embodiment, the lips on the one half extend outwardly from the locking tongues away from the axis of the core barrel, and the lips on the other half extend inwardly from the notches toward the axis of the core barrel.

In another embodiment, the sampling system includes full length locking tabs extending from the tongues and the grooves of the respective halves to preclude movement of the halves relative to one another in the direction perpendicular to the joining plane.

Yet another way in which the objects of the invention have been met is to provide of an embodiment of the invention with a core barrel for retrieving soil samples such that the core barrel has two halves, and the halves are configured to be joined substantially along a plane to form a cylinder having a through bore and an inner and outer diameter. Each of the halves includes a pair of longitudinally extending edges, and the halves include locking means for locking the halves together to prevent lateral movement of the halves relative to one another with respect to an axis of the core barrel. The locking means can also preclude movement of the halves relative to one another in a direction perpendicular to the plane.

The locking means may include locking tongues extending along the length of each edge of the inner diameter on one half, and the tongues on the one half mate with respective notches extending along the length of each edge of the other half.

Another feature of an embodiment of the invention is to include intermittent locking tabs to preclude movement of the halves relative to one another in the direction perpendicular to the joining plane. The intermittent locking tabs may extend from the tongues and notches of the respective halves.

Yet another feature of an embodiment of the invention is that the intermittent locking tabs include lips extending from the tongues and notches of the respective halves. In one embodiment shown, the lips extend in a direction substantially parallel to the joining plane. The lips on the one half may extend outwardly from the locking tongues away from the axis of the core barrel. The lips on the other half may extend inwardly from the notches toward the axis of the core barrel.

In another embodiment of the invention, the core barrel includes full length locking tabs extending from the tongues and grooves of the respective halves to preclude movement of the halves relative to one another in the direction perpendicular to the joining plane.

The objects of the invention have been further met by providing a core barrel for retrieving soil samples wherein the core barrel has two halves, and the halves are configured to be joined substantially along a plane to form a cylinder having a through bore and an inner and outer diameter. Each of the halves includes a pair of longitudinally extending edges, and the halves have a locking configuration to preclude movement of the halves relative to one another in a direction perpendicular to the plane. The locking configuration may be engaged by matching respective edges of the halves to one another to form the cylinder while the halves are offset from one another along an axis of the core barrel. Then, at least one of the halves is slid relative to the other so that the halves are substantially even along the axis of the core barrel.

The locking configuration in this embodiment may also prevent lateral movement of the halves relative to one another with respect to the axis of the core barrel.

This summary is intended only as an aid in describing some of the features of the invention which are more fully described in the following detailed description and attached figures. The summary is not intended to limit the invention in any manner as the invention resides not in any of these features per se, but rather as defined by the attached claims.

BRIEF DESCRIPTION OF THE DRAWINGS

The above-mentioned and other features and objects of this invention and the manner of obtaining them will become more apparent and the invention itself will be better understood by reference to the following description of an embodiment of the present invention taken in conjunction with the accompanying drawings, wherein:

FIG. 3A is a cross-sectional view of the upper half of the split barrel core sampler of FIG. 1 showing locking tongues;

FIG. 3B is a cross-sectional view of the lower half of the split barrel core sampler of FIG. 1 showing locking grooves;

FIG. 4 is a perspective view of the split barrel core sampler of the present invention with the halves of the barrel separated to show locking tabs.

Figure 1:
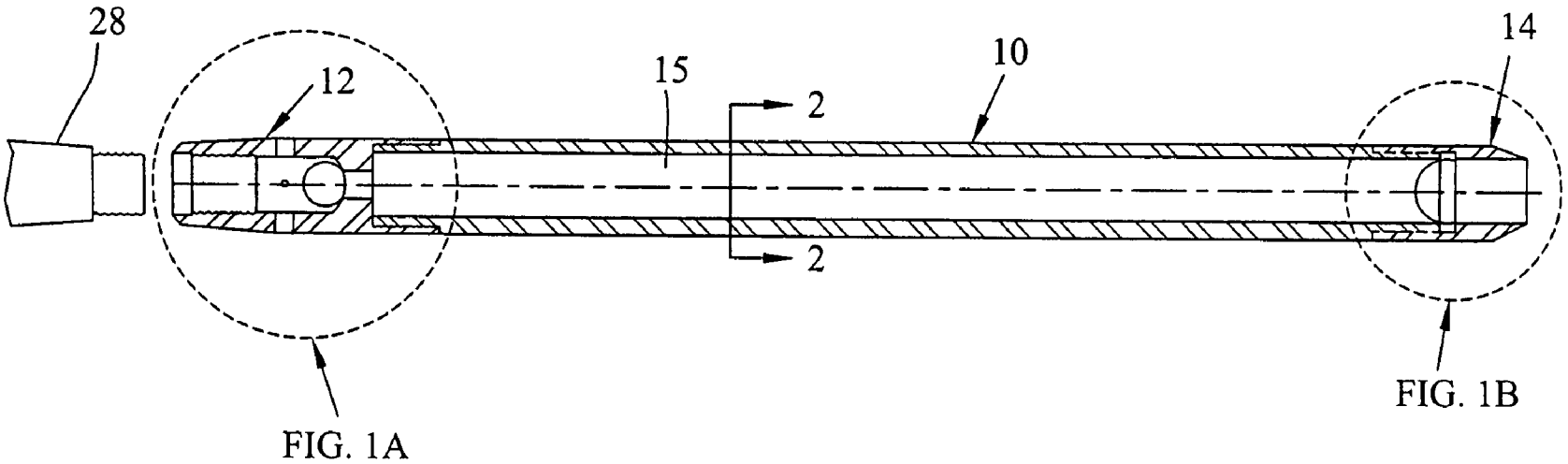
FIG. 1 PRIOR ART
FIG. 1 is a cross-sectional view of prior art split barrel sampler assembly.

Corresponding reference characters indicate corresponding parts throughout the several views. Although the drawings represent embodiments of the present invention, the drawings are not necessarily to scale and certain features may be exaggerated in order to better illustrate and explain the present invention. The discussion that follows illustrates certain embodiments of the invention and is not to be construed as limiting the scope of the invention in any manner.

DETAILED DESCRIPTION OF THE PREFERRED EMBODIMENT

The embodiments disclosed below are not intended to be exhaustive or to limit the invention to the precise forms disclosed in the detailed description. Rather, the embodiments are chosen and described so that others skilled in the art might utilize their teachings.

The present invention may be utilized with a conventional drill rig such as is illustrated in commonly owned U.S. Pat. No. 5,360,072, incorporated herein by reference. In addition, the present invention is particularly suited for use with drills of a vibratory nature such as is disclosed, for example, in U.S. Pat. Nos. 5,027,908 and 5,409,070 to Roussy and in pending commonly owned patent application Ser. No. 10/083,206, all of which are incorporated herein by reference.

The vibratory drill can be used to drive a conventional prior art split barrel core sampler generally indicated as 10, as is well known in the art, and shown in FIG. 1. A prior art adapter coupling generally indicated as 12 is connected to one end of the core sampler and a drive shoe generally indicated as 14 is connected to the other end. Split barrel core sampler 10, adapter coupling 12, and drive shoe 14 are aligned generally along an axis A.

Figure 1A:
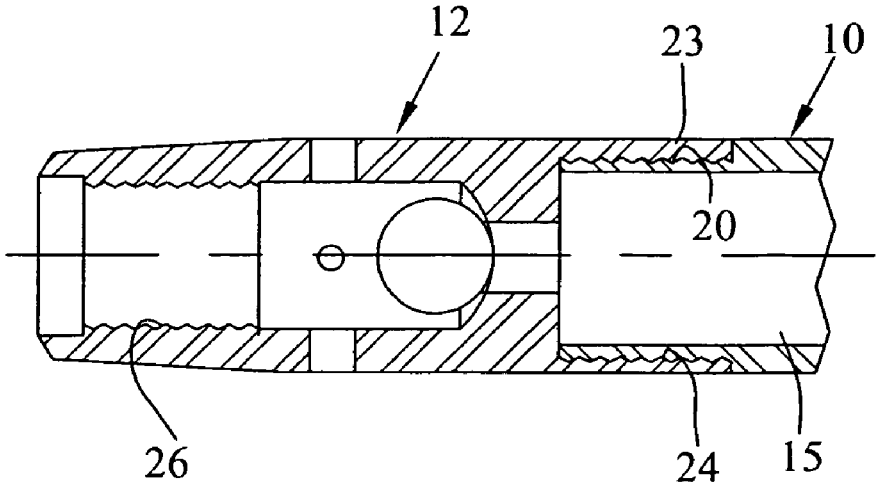
FIG. 1A PRIOR ART
FIG. 1A is a close up view taken where shown in FIG. 1 of a prior art adapter connected to a split barrel core sampler.
Figure 1B:
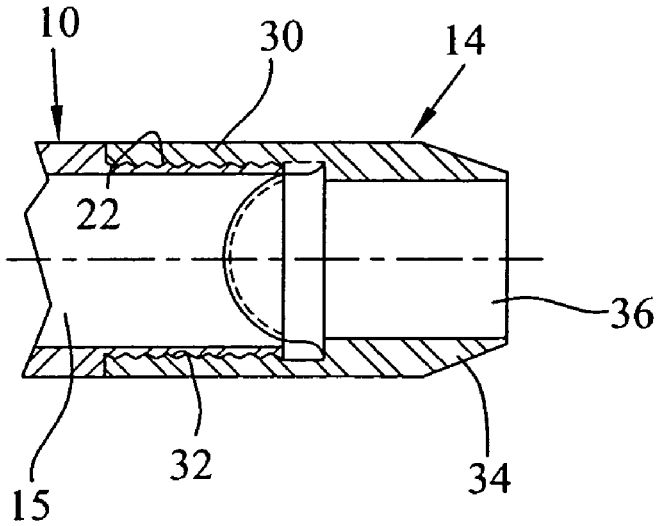
FIG. 1B PRIOR ART
FIG. 1B is a close up view taken where shown in FIG. 1 of a drive shoe connected to the split barrel core sampler.
Figure 2:
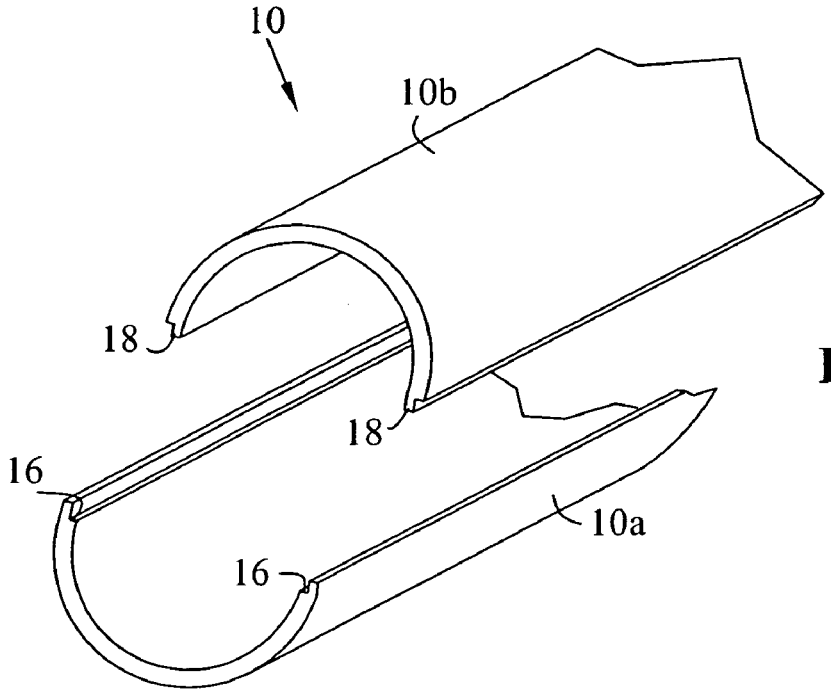
FIG. 2 PRIOR ART
FIG. 2 is an exploded perspective view of a prior art tongue and groove split barrel core sampler.
Figure 3:
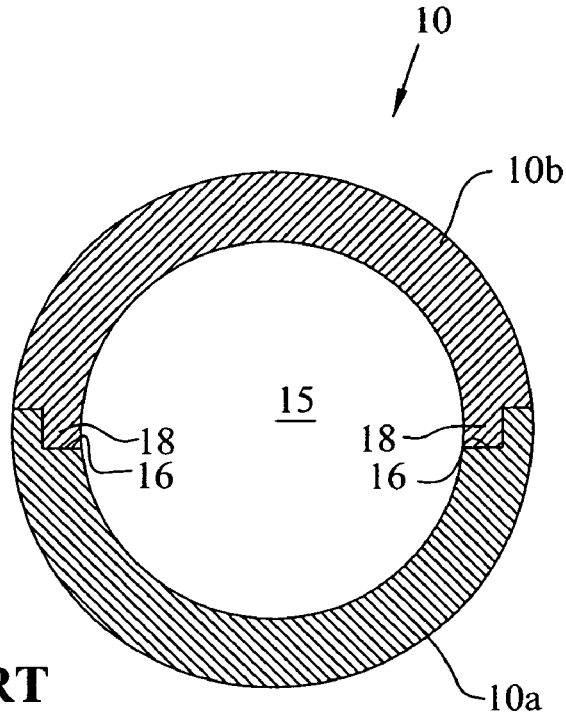
FIG. 3 PRIOR ART
FIG. 3 is a cross-sectional view of the split barrel core sampler taken along line 2—2 of FIG. 1.

As shown in FIGS. 2, 3, 3A and 3B, split barrel core sampler (core barrel) 10 is constructed of two longitudinally extending cylindrical halves 10*a*, 10*b* defining an inner bore 15. Half 10*a* has a groove or notch 16 located along the edges of the half cylinder along the length thereof and towards the internal diameter of the half. Grooves 16 mate with corresponding longitudinally extending tongues 18 located along the inner diameter edges of half 10*b*. Grooves 16 and tongues 18 interlock to prevent lateral movement of the halves with respect to one another. Split barrel core sampler 10 also has opposite externally threaded ends 20, 22 for connecting the core sampler to the adapter coupling 12 and drive shoe 14, respectively (FIGS. 1A and 1B). The sampling assembly is typically manufactured from a steel such as 4140.

Adapter coupling 12 has an extension 23 on one end thereof having internal threads 24 for mating with external threads 20 of split barrel core sampler 10 as shown in FIG. 1A. The opposite end of adapter coupling 12 has an internally threaded bore 26 for connection to a drill rod 28 (FIG. 1).

Referring to FIG. 1B, drive shoe 14 has an extension 30 on one end thereof having internal threads 32 for mating with external threads 22 of split barrel core sampler 10. The opposite end 34 of drive shoe 14 is tapered to facilitate driving the drive shoe into the ground. A hollow bore 36 extends through drive shoe 14 for receiving a soil sample (not shown) and allowing it to pass through to split barrel core sampler 10.

Now referring to FIGS. 4–7A, a locking split barrel core sampler or core barrel of the present invention is generally indicated as 110. Like the prior art split barrel core sampler 10, core barrel 110 is constructed of two longitudinally extending cylindrical halves 110*a*, 110*b* that define an inner bore 115. The halves 110*a*, 110*b* of the locking core barrel 110 are joined generally along a plane P (FIG. 5), which extends perpendicularly into the paper. Core barrel 110 and inner bore 115, which extends through the core barrel, define an outer diameter $D_0$ and an inner diameter $D_I$.

Figure 7:
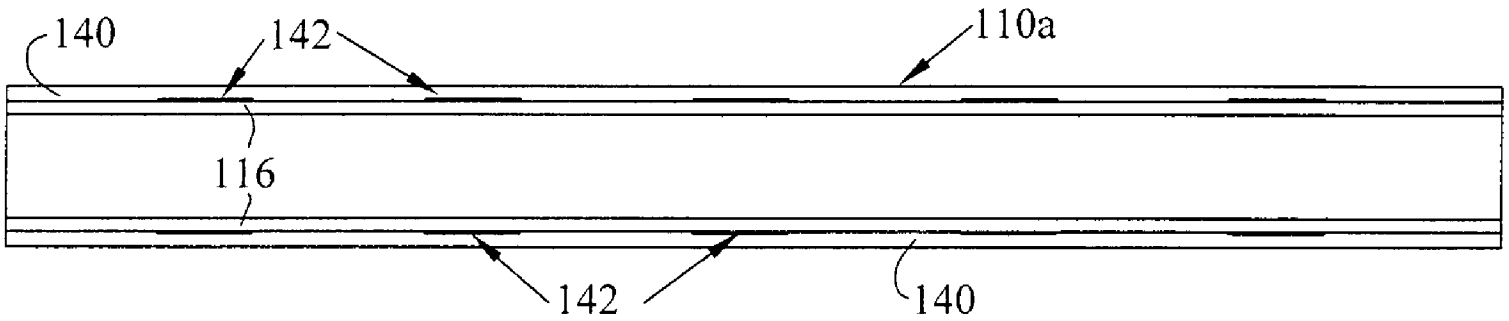
FIG. 7 is a plan view showing the locking tabs on the lower half of the split barrel core sampler.
Figure 7A:
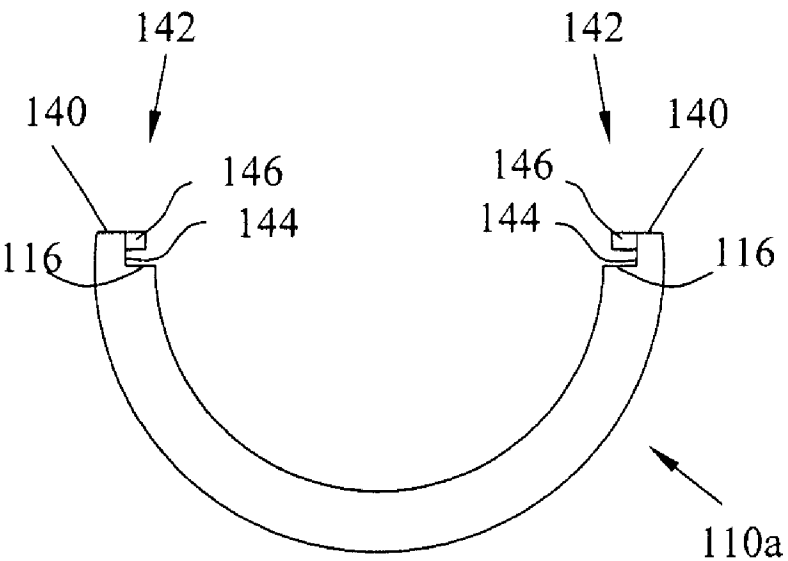
FIG. 7A is an end view of the lower half of the split barrel core sampler.

As best shown in FIG. 7A, half 110*a* includes grooves or notches 116, longitudinal edges 140, intermittent locking tabs generally indicated as 142, wall portions 144, and lips 146. Longitudinal edges 140 extend along the length of the half cylinder portion 110*a*. Grooves 116 extend along the length of longitudinal edges 140, and have a width defined by the wall portions 144 and the inner diameter $D_I$ of the half cylinder. Intermittent locking tabs 142 are formed by lips 146, which extend from wall portions 144 into the grooves 116 toward axis A in a direction substantially parallel to plane P.

Figure 6:
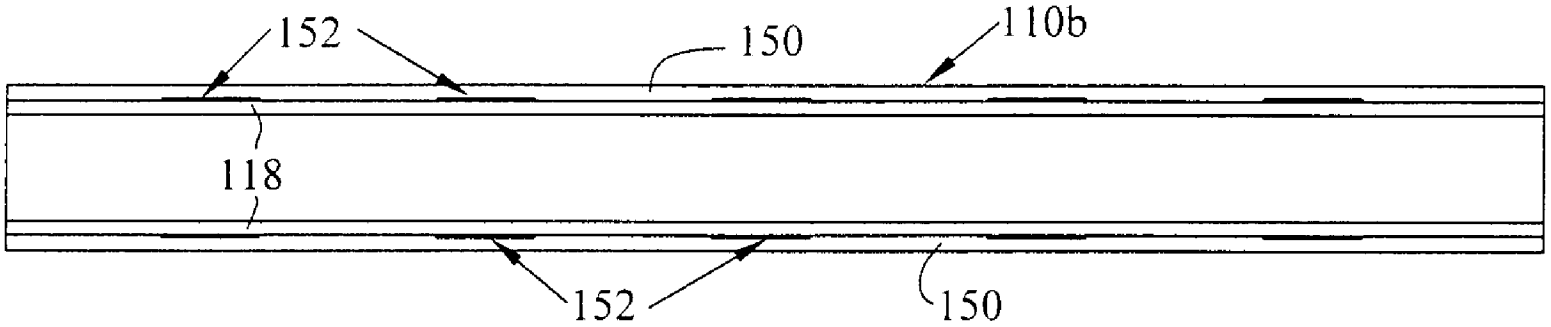
FIG. 6 is a plan view showing the locking tabs of the upper half of the split barrel core sampler.
Figure 6A:
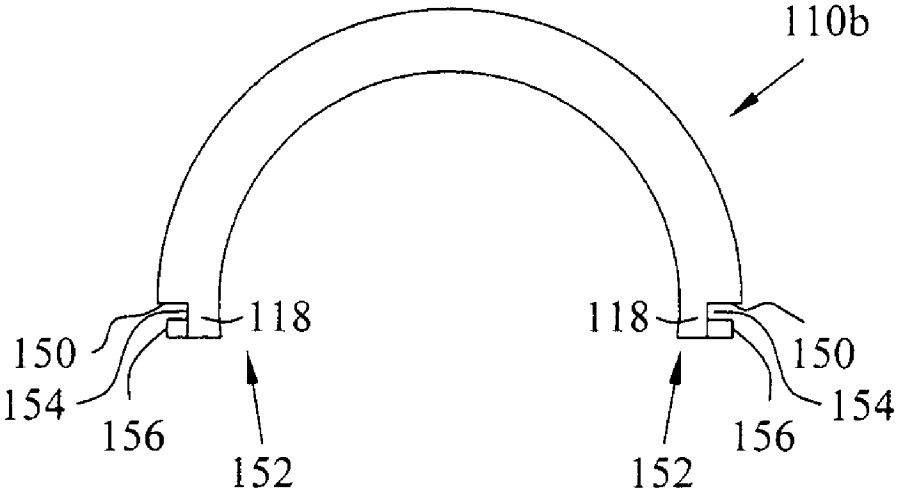
FIG. 6A is an end view of the upper half of the split barrel core sampler.

Referring to FIG. 6A, half 110*b* includes tongues 118, longitudinal edges 150, intermittent locking tabs generally indicated as 152, wall portions 154, and lips 156. Longitudinal edges 150 extend along the length of the half 110*b*. Tongues 118 extend along longitudinal edges 150, and have a width defined by wall portions 154 and the inner diameter $D_I$. Intermittent locking tabs 152 are formed by lips 156 that extend from wall portions 154 outwardly away from axis A in a direction substantially parallel to plane P.

Figure 5:
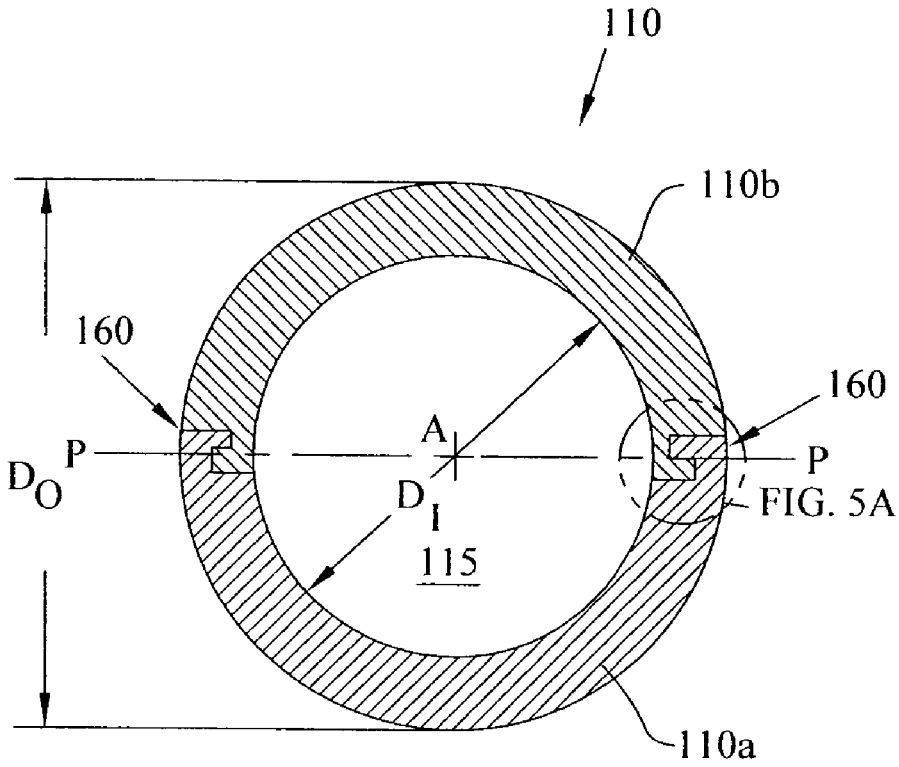
FIG. 5 is a cross-sectional view of the split barrel core sampler of the present invention taken at a place corresponding to line 2—2 of FIG. 1, and through the locking tabs shown in FIG. 4.
Figure 5A:
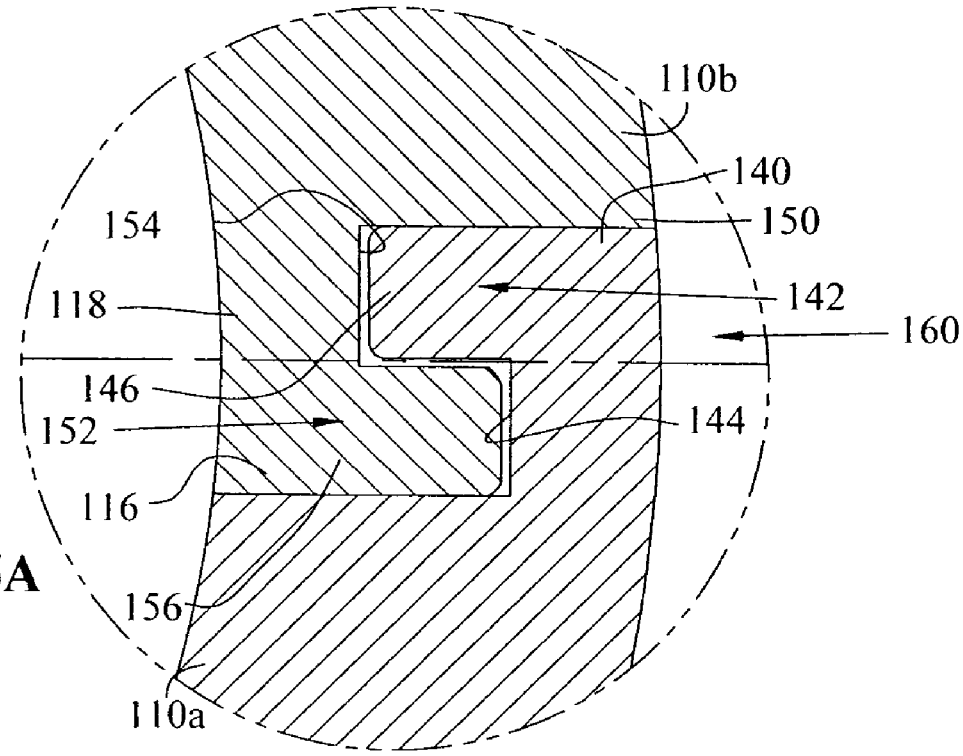
FIG. 5A is a close up view of the joined locking tabs taken where shown in FIG. 5.

When assembled, the grooves 116 and locking tabs 142 of half 110*a* together with the tongues 118 and locking tabs 152 define locking configurations generally indicated as 160 (FIG. 5). To assemble the halves 110*a*, 110*b* into core barrel 110, the halves are placed with edges 140 facing respective edges 150. To start, the halves are offset slightly from one another such that the intermittent locking tabs 142 of half 110*a* are offset axially from respective locking tabs 152 so that longitudinally extending tongues 118 of half of 110*b* can be received in grooves 116 of half 110*a*. One or both of the halves are then slid axially with respect to one another so that lips 146 and 156 are lockingly engaged as shown in FIGS. 5 and 5A. It should be in apparent that the locking configuration 160 must be sized such that lips 146 will extend beneath lips 156 and stop slightly short of outer wall portions 154. Likewise, lips 156 must be narrow enough and long enough to extend beneath lips 146 and should be sized to stop slightly short of wall portions 144.

Adapter coupling 12 and drive shoe 14 may then be threaded on the respective ends of core barrel 110 such that it is ready to be installed onto drill rod 28 for obtaining a soil sample.

In operation, drive shoe 14 is driven into the ground such that a soil sample passes through hollow bore 36 and into bore 115 of core barrel 110. Adapter coupling 12 and drive shoe 14 hold the halves 110*a*, 110*b* together at the ends of the core barrel and also prevent the halves from moving along axis A relative to one another so that locking configuration 160 is maintained. Furthermore, the locking configuration 160, wherein tabs 142 are interlocked with tabs 152, will prevent the pressure from the soil in bore 115 from swelling or pulling the halves apart from one another along the length of the core barrel.

Once the core barrel has been inserted into the ground to the appropriate depth for the required soil sample, it may be withdrawn by removing the entire drill string. Once withdrawn, the soil sample may be obtained by unscrewing the adapter coupling 12 and drive shoe 14 from the respective ends of the core barrel. One or both of the halves 110*a*, 110*b* may then be axially slid with respect to one another until locking tabs 142, 152 are offset and become disengaged from one another. This allows the halves to be separated so that the soil sample may be readily accessed.

While the invention has been taught with specific reference to the above embodiment, someone skilled in the art will recognize that changes can be made in form and detail without departing from the spirit and scope of the invention. For example, other materials may be used for the locking split core barrel, and the threads on the end may be altered from part to part as to which part has the external and which part has the internal threading. Also, locking tabs 142, 152 may extend for the full length of core barrel 110; however, this will require that the barrels be completely offset axially from one another before assembling the core barrel so that the locking tabs may be slidingly engaged along the full length of the core barrel.

Other locking configurations or means may also be utilized with the present invention. For instance, only one of the halves may have locking tabs or lips, and the opposing wall may merely have intermittent or full length slots along the respective wall portions 144, 154. Additionally, the locking configuration 160 may be reversed such that half 110*a* includes tongue 118 and half 110*b* includes the groove 116, with respective locking tabs also reversed. Therefore, the described embodiments are to be considered in all respects only as illustrative and not restrictive. The scope of the invention is therefore, indicated by the following claims rather than by the description.

The inventioned claimed is:

1. A core barrel for retrieving soil samples, said core barrel comprising two halves, said halves configured to be joined substantially along a plane to form a cylinder having a through bore defining an inner and outer diameter, each of said halves including a pair of longitudinally extending edges, and said halves including a releasable locking configuration extending along said longitudinally extending edges beyond any region where an end coupling or drive shoe may be attached to prevent lateral movement of said halves relative to one another with respect to an axis of the core barrel and to also preclude movement of said halves relative to one another in a direction perpendicular to the plane.

2. The core barrel as set forth in claim 1, wherein said locking configuration includes locking tongues extending along at least a portion of the length of each edge along the inner diameter on one half.

3. The core barrel as set forth in claim 2, wherein said tongues on said one half mate with respective notches extending along at least a portion of the length of each edge of said other half.

4. The core barrel as set forth in claim 3, further including full length locking tabs extending from said tongues and said grooves of said respective halves to preclude movement of said halves relative to one another in the direction perpendicular to the joining plane.

5. The core barrel as set forth in claim 1, further including locking tabs intermittently spaced along the longitudinal edges of the halves to preclude movement of said halves relative to one another in the direction perpendicular to the joining plane.

6. The core barrel as set forth in claim 5, including locking tongues extending along the length of each edge along the inner diameter on one half that mate with respective notches extending along the length of each edge of said other half and wherein said intermittent locking tabs extend from said tongues and said notches.

7. The core barrel as set forth in claim 6, wherein said intermittent locking tabs include lips extending from said tongues and said notches of said respective halves.

8. The core barrel as set forth in claim 7, wherein said lips extend in a direction substantially parallel to said joining plane.

9. The core barrel as set forth in claim 8, wherein said lips on said one half extend outwardly from said locking tongues away from the axis of said core barrel.

10. The core barrel as set forth in claim 9, wherein said lips on said other half extend inwardly from said notches toward the axis of said core barrel.

11. A soil sampling system comprising a drill rod, a core barrel for receiving a soil sample, an adapter coupling for coupling said core barrel to said drill rod, and a drive shoe attached to an end of said core barrel for penetrating the ground, said core barrel including two halves, said halves configured to be joined substantially along a plane to form a cylinder having a through bore defining an inner and outer diameter, each of said halves including a pair of longitudinally extending edges, and said halves including a releasable locking configuration to prevent lateral movement of said halves relative to one another with respect to an axis of the core barrel and to also preclude movement of said halves relative to one another in a direction perpendicular to the plane.

12. The sampling system as set forth in claim 11, wherein said locking configuration includes locking tongues extending along at least a portion of the length of each edge along the inner diameter on one half.

13. The sampling system as set forth in claim 12, wherein said tongues on said one half mate with respective notches extending along at least a portion of the length of each edge of said other half.

14. The sampling system as set forth in claim 13, further including locking tabs intermittently spaced along the longitudinal edges of the halves to preclude movement of said halves relative to one another in the direction perpendicular to the joining plane.

15. The sampling system as set forth in claim 14, wherein said intermittent locking tabs extend from said tongues and said notches of said respective halves.

16. The sampling system as set forth in claim 15, wherein said intermittent locking tabs include lips extending from said tongues and said notches of said respective halves.

17. The sampling system as set forth in claim 16, wherein said lips extend in a direction substantially parallel to said joining plane.

18. The sampling system as set forth in claim 17, wherein said lips on said one half extend outwardly from said locking tongues away from the axis of said core barrel.

19. The sampling system as set forth in claim 18, wherein said lips on said other half extend inwardly from said notches toward the axis of said core barrel.

20. The sampling system as set forth in claim 13, further including full length locking tabs extending from said tongues and said grooves of said respective halves to preclude movement of said halves relative to one another in the direction perpendicular to the joining plane.

21. A core barrel for retrieving soil samples, said core barrel comprising two halves, said halves configured to be joined substantially along a plane to form a cylinder having a through bore defining an inner and outer diameter, each of said halves including a pair of longitudinally extending edges, and said halves including releasable locking means at least a part of which is located in a central portion away from the ends of said core barrel for locking said halves together to prevent lateral movement of said halves relative to one another with respect to an axis of the core barrel and to also preclude movement of said halves relative to one another in a direction perpendicular to the plane.

22. The core barrel as set forth in claim 21, wherein said locking means includes locking tongues extending along at least a portion of the length of each edge along the inner diameter on one half.

23. The core barrel as set forth in claim 22, wherein said tongues on said one half mate with respective notches extending along at least a portion of the length of each edge of said other half.

24. The core barrel as set forth in claim 23, further including locking tabs intermittently spaced along the longitudinal edges of the halves to preclude movement of said halves relative to one another in the direction perpendicular to the joining plane.

25. The core barrel as set forth in claim 24, wherein said intermittent locking tabs extend from said tongues and said notches of said respective halves.

26. The core barrel as set forth in claim 25, wherein said intermittent locking tabs include lips extending from said tongues and said notches of said respective halves.

27. The core barrel as set forth in claim 26, wherein said lips extend in a direction substantially parallel to said joining plane.

28. The core barrel as set forth in claim 27, wherein said lips on said one half extend outwardly from said locking tongues away from the axis of said core barrel.

29. The core barrel as set forth in claim 28, wherein said lips on said other half extend inwardly from said notches toward the axis of said core barrel.

30. The core barrel as set forth in claim 23, further including full length locking tabs extending from said tongues and said grooves of said respective halves to preclude movement of said halves relative to one another in the direction perpendicular to the joining plane.

31. A core barrel for retrieving soil samples, said core barrel comprising two halves, said halves configured to be joined substantially along a plane to form a cylinder having a through bore defining an inner and outer diameter, each of said halves including a pair of longitudinally extending edges, and said halves including a releasable locking configuration to preclude movement of said halves to relative to one another in a direction perpendicular to the plane, said locking configuration being engaged by matching respective edges of said halves to one another to form said cylinder while said halves are offset from one another along an axis of said core barrel and then sliding at least one of said halves relative to the other so that said halves are substantially even along the axis of said core barrel.

32. The core barrel as set forth in claim 31, wherein said locking configuration also prevents lateral movement of said halves relative to one another with respect to the axis of said core barrel.

* * * * *